United States Patent [19]

Slone

[11] 4,174,779

[45] Nov. 20, 1979

[54] CARRYING CASE FOR BOTTLES

[75] Inventor: Adolph Slone, Englewood, N.J.

[73] Assignee: Schenley Industries, Inc., New York, N.Y.

[21] Appl. No.: 925,713

[22] Filed: Jul. 18, 1978

[51] Int. Cl.[2] ..... B65D 65/08

[52] U.S. Cl. ..... 206/427; 211/72; 211/76

[58] Field of Search ..... 206/203, 429, 434, 194, 206/197, 198, 199, 418, 419, 427, 139, 142, 159, 168; 220/DIG. 12, DIG. 15, 23.6, 23.8; 211/76, 72, 60 A

[56] References Cited

U.S. PATENT DOCUMENTS

| | | | |
|---|---|---|---|
| 2,282,482 | 5/1942 | Koenig | 206/168 |
| 2,441,134 | 5/1948 | Brogden et al. | 206/142 |
| 2,857,048 | 10/1958 | Johnson | 206/197 |
| 3,673,987 | 7/1972 | Fletcher | 220/23.6 |
| 3,773,214 | 11/1973 | Lemon | 206/194 |
| 3,986,628 | 10/1976 | Prödel | 206/203 |

FOREIGN PATENT DOCUMENTS

| | | | |
|---|---|---|---|
| 225236 | 10/1959 | Australia | 206/194 |
| 1209704 | 10/1970 | United Kingdom | 206/419 |

*Primary Examiner*—Stephen P. Garbe
*Attorney, Agent, or Firm*—Blum, Moscovitz, Friedman & Kaplan

[57] ABSTRACT

A lightweight case for carrying bottles comprises a rack member having bottom and apertured side faces of a rigid but flexible plastic for engaging the bottom and side portion of each of a plurality of bottles. The case also includes a clip for gripping the top edges of the side faces and drawing the top portions of the side faces against the shoulders of the bottles, thereby holding the bottles securely within the case.

8 Claims, 6 Drawing Figures

CARRYING CASE FOR BOTTLES

BACKGROUND OF THE INVENTION

In the vending of relatively low-priced items, it has now been the practice for a substantial period of time to package several of one type of item for sale together with the objective of increasing the size of the transaction. Bottles of soft drink have been sold in this way for a number of years, and many types of packaging have been devised, the emphasis, as would be expected, having been on low price for the package, as well as convenience and economy in space in the unfilled condition.

With the advent of relatively inexpensive sheet plastic having a suitable degree of both rigidity and flexibility, the design of hitherto unavailable types of packages has become possible. Moreover, the market for such types of packaging has increased, due to the fact that small containers of alcoholic beverages are now being vended. The present invention is directed to an inexpensive, lightweight and secure case suitable for storing and carrying a number of aligned bottles.

SUMMARY OF THE INVENTION

A lightweight case for carrying and storing aligned bottles comprises a rack member and a clip member. The rack member includes a bottom face and two apertured side faces, the apertures being sized so that the bottles to be held in said case will, in part, protrude through same. A clip member engages the top edges of the side faces, pulling the top portions of the side faces together so that the side faces of the rack member engage the shoulders of the bottles, the bottles being held securely by the bottom face of the rack member, the edges of the apertures through which the bottles protrude and the top portions of the side faces which make contact with the shoulders of the bottles. Preferably, the clip member has an opening therethrough for receiving the neck of a bottle. Further security in the holding of this bottle is provided by sizing the opening in said clip member to engage the neck of the bottle with the edge of the opening.

Preferably, at least one of said rack member and said clip member are molded of a synthetic resin which is rigid enough to hold said bottle securely and flexible enough to adapt itself to the shape of the bottles. As is evident, the bottles held in such a case will be in a line.

As is evident, the flexibility of the material of which the rack member is made will provide for ready engagement and disengagement of same from said clip member by moving the top edges of said side faces inwardly and outwardly from each other. Also, the flexibility of said rack member provides for stacking of said rack members. Further, said clip member is preferably of generally-planar configuration, thereby providing for stacking of said clip members, the stackability of said rack members and clip members providing for economy of space in shipment and in storage when unfilled. Also, the carrying case can be reused.

Accordingly, an object of the present invention is a lightweight case for storing and carrying aligned bottles, said case being low in cost.

Another object of the present invention is a lightweight case of low cost for carrying and storing aligned bottles where a high degree of security against accidental dislodgement of said bottles from said case is required.

A further object of the present invention is a lightweight, low cost case for carrying and storing aligned bottles where said case is of two-piece construction and said pieces are separately stackable for storage.

An important object of the present invention is a lightweight, low-cost case for carrying and storing aligned bottles where said case comprises a rack member and a clip member, at least one of said rack member and said clip member being moldable of a synthetic resin.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
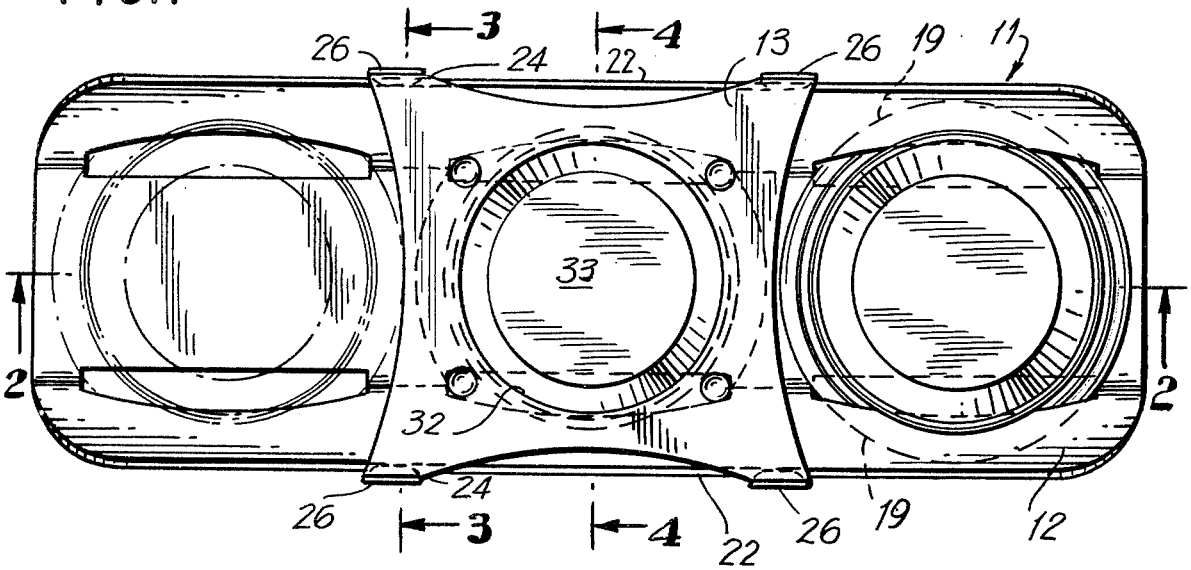
FIG. 1 is a plan view of a carrying case in accordance with the present invention with a bottle in place.
Figure 2:
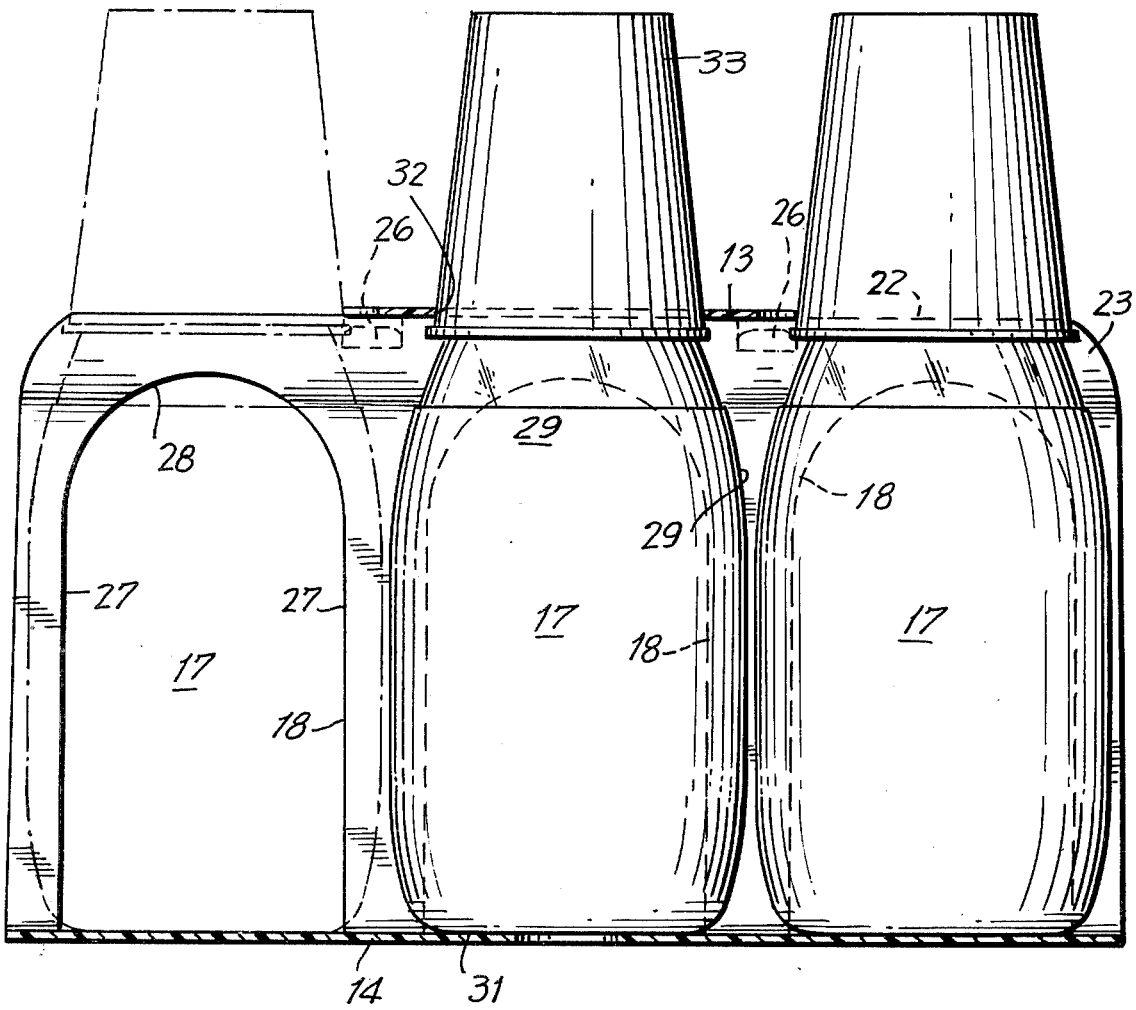
FIG. 2 is a sectional view taken along line 2—2 of FIG. 1.
Figure 6:
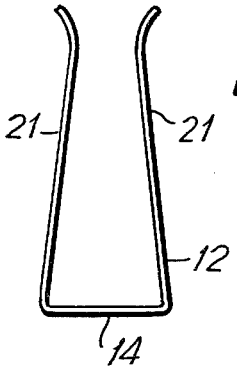
FIG. 6 is an end view of a rack element in reduced scale.

A case for holding and carrying aligned bottles is indicated generally in FIG. 1 by the reference numeral 11, said case comprising a rack member 12 and a clip member 13. Rack member 12 is shown in end view and in reduced scale in FIG. 6 prior to insertion of bottles therein. The width of bottom face 14 of rack member 12 is less than the diameter 16 of a bottle 17 to be held in said rack.

Apertures, indicated by the reference numerals 18 make it possible for the case to hold bottles having a diameter greater than the width of the bottom face of the rack member, the body 19 of each bottle protruding through both side faces 21 of the rack member 12.

Figure 3:
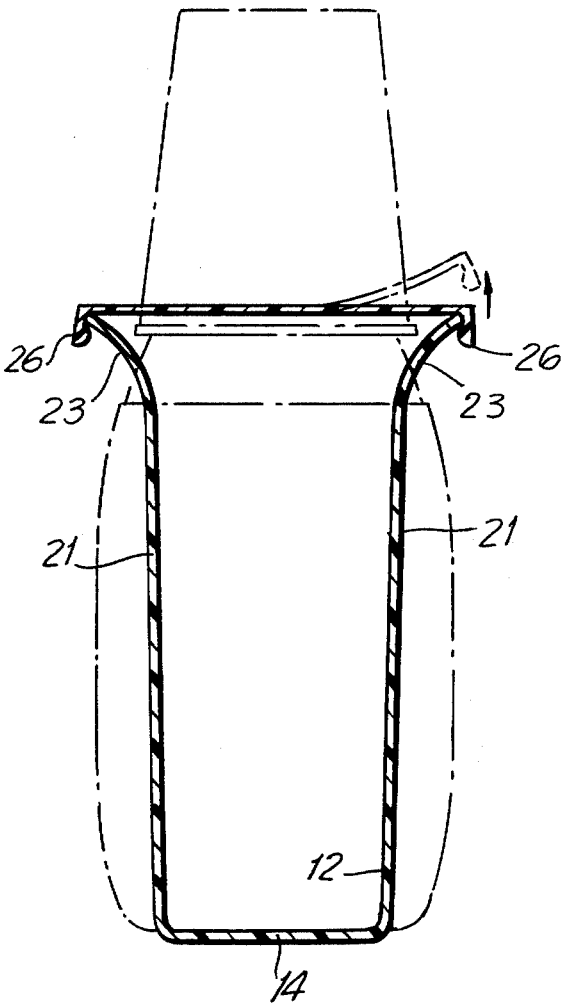
FIG. 3 is a sectional view taken along line 3—3 of FIG. 1.

Clip member 13 engages top edges 22 of side faces 21, the width of clip member 13 being such that the top portions 23 of side faces 21 must be drawn together for engagement of top edges 22 with both sides 24 of clip member 13. Preferably, each side of clip member 13 has two segments 26 notched for engagement with top edges 22, so that each side face 21 is held at two points. To engage clip member 26 with top edges 22, top portions 23 are pressed together, either manually or by machine, clip member 13 is brought into position and the top portions are released. Also, clip member 13 may be made flexible enough so that it can be snapped into and out of place as indicated in FIG. 3, thereby grasping and releasing said side faces.

Apertures 18 each have side edges 27 and a top rim 28 which make contact with body 19 and shoulder 29 of each bottle, so that each bottle is held by bottom face 14 engaged with the bottom 31 thereof, side edges 27 of the corresponding aperture 18 engaged with the body 19 of the bottle and top rim 28 engaged with shoulder 29 of the bottle. Additional security is provided by an opening 32 in clip member 13 which preferably is sized so that the edge thereof engages top 33 of at least one bottle in the case. As is evident, more than one clip member may be used with a rack member, depending upon the length thereof. Also, clip member 13, in an embodiment not shown, spans two or more bottles, having openings therein for those bottles spanned, and may have more than two clip member segments 26 on each side thereof.

Figure 4:
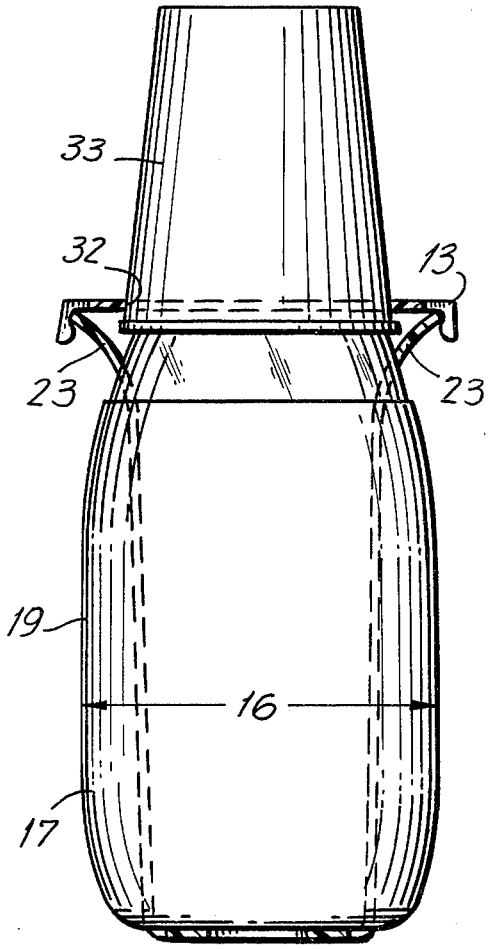
FIG. 4 is a sectional view taken along line 4—4 of FIG. 1.
Figure 5:
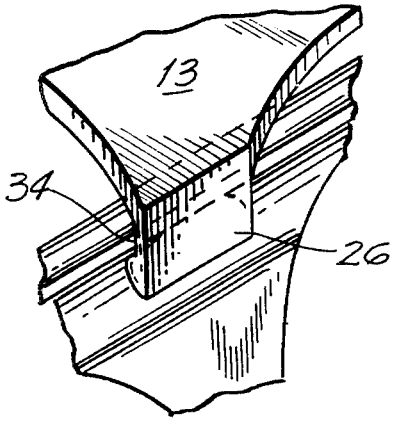
FIG. 5 is a partial view in enlarged section of a clip element in engagement with the top edge of a rack element.

In the preferred construction shown in the Figures, top portions 23 of side faces 21 flare outwardly, thus providing rigidity against bending around a vertical axis. Moreover, this outward flaring provides for engagement of top edges 22 with notch 34 in clip member segment 26 as shown in FIGS. 3 and 4, and especially in FIG. 5. Preferably, the thickness of clip member segment 26 is greater than that of the remainder of clip member 13 to provide rigidity and the necessary strength for restraining and holding top edges 22.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A lightweight case for storing and carrying a plurality of bottles in aligned relationship, each of said bottles having a neck, a shoulder and a body, said case comprising:

a one-piece rack member of a rigid, flexible plastic having an elongated bottom face for supporting said bottles, the width of said bottom face being less than the diameter of said body;

a pair of side faces each joined at the bottom edge thereof to a side edge of said bottom face, each side face having apertures each having side edges and a top rim therein for permitting said bodies to protrude therethrough, each side face having a top edge, the height of said side face corresponding approximately to the height of said shoulders above the bottoms of said bottles to be held in said rack; and a clip member having first and second spaced-apart clip elements for receiving and holding releasably said top edges of said side faces, the distance between said clip elements being such that said top edges must be displaced toward each other over said shoulders of said bottles for said top edges to be received and held by said clip member, thereby providing for engagement of each by said bottom face and by said side edges and top rim of an aperture in each side face whereby each of said bottles is securely held against accidental dislodgement.

2. A lightweight case for storing and carrying a plurality of bottles in aligned relationship, as defined in claim 1, wherein said top edges of said side faces turn outwardly from each other and each of said clip elements is notched for receiving and holding a top edge by movement of said top edges toward each other and subsequent movement apart.

3. A lightweight case for storing and carrying a plurality of bottles in aligned relationship, as defined in claim 1, wherein said clip member has an opening therein for receiving therethrough the neck of a bottle in said rack member.

4. A lightweight case for storing and carrying a plurality of bottles in aligned relationship, as defined in claim 3, wherein each of said clip elements comprising at least two spaced-apart clip segments, thereby providing for holding each of said side faces at at least two points.

5. A lightweight case for storing and carrying a plurality of bottles in aligned relationship, as defined in claim 3, wherein said opening in said clip member is of such size as to provide for engagement of the edge of same with the neck of the bottle to be held therein.

6. A lightweight case for storing and carrying a plurality of bottles in aligned relationship, as defined in claim 1, wherein said side faces, when said rack is free of bottles, converge toward each other from said bottom to said top edges, thereby providing for holding bottles in place on insertion of bottles and prior to emplacement of said clip member.

7. A lightweight case for storing and carrying a plurality of bottles in aligned relationship, as defined in claim 1, wherein at least one of said clip member and rack member is of molded construction.

8. A lightweight case for storing and carrying a plurality of bottles in aligned relationship, as defined in claim 1, wherein said rack member is sized and apertured for holding three bottles and said clip member has a single opening therein for receiving a neck of a bottle.

* * * * *